United States Patent [19]

Kabana

[11] Patent Number: 4,699,382

[45] Date of Patent: Oct. 13, 1987

[54] APPARATUS FOR SELECTING NUMBERS

[76] Inventor: Joseph A. Kabana, 144 Delaware Dr., Coraopolis, Pa. 15108

[21] Appl. No.: 770,755

[22] Filed: Aug. 29, 1985

[51] Int. Cl.[4] ..... A63F 9/00; G07C 15/00

[52] U.S. Cl. ..... 273/144 B

[58] Field of Search ..... 273/144, 145 C; D21/39

[56] References Cited

U.S. PATENT DOCUMENTS

| | | | |
|---|---|---|---|
| 386,577 | 7/1888 | De Grain | 273/145 C |
| 2,233,589 | 3/1941 | Dean | 273/144 B |
| 2,249,079 | 7/1941 | Garrett | 273/145 C |
| 3,106,402 | 10/1963 | Rushing, Jr. | 273/144 B |

FOREIGN PATENT DOCUMENTS

| | | | |
|---|---|---|---|
| 148995 | 11/1952 | Australia | 273/144 B |
| 94711 | 9/1959 | Norway | 273/144 B |
| 481 | of 1900 | United Kingdom | 273/144 B |
| 1015047 | 12/1965 | United Kingdom | 273/144 B |

*Primary Examiner*—Paul E. Shapiro

*Attorney, Agent, or Firm*—Martin J. Carroll

[57] ABSTRACT

Apparatus for selecting a multi-digit number. A cage is defined by two end pieces, a plurality of peripherally spaced slats extending between the end pieces and wire mesh extending around and attached to the periphery of the end pieces is rotatable about a horizontal longitudinal axis. A plurality of balls with numbers thereon are enclosed in the cage. A plurality of single ball receiving pockets on the periphery of the cage spaced apart in a line parallel to the cage axis. The inner ends of the pockets are secured to one of the slats, which is wider than the remaining slats so as to be of sufficient weight along the parallel line so that the line is at the bottom of the cage when it is at rest.

6 Claims, 8 Drawing Figures

APPARATUS FOR SELECTING NUMBERS

This invention relates to apparatus for selecting numbers and more particularly to such apparatus for selecting winning numbers in games of chance. For example, many states of the United States now have lotteries and the winning numbers are selected in various ways. It is common to use numbered balls in a rotatable cage for this purpose with balls being selected therefrom to determine the numbers. This selection may be by hand or by a vacuum. In either case the human element enters into the selection. There is also the possibility of fraud in the selection. There is also the possibility of vacuum failure which would require an alternate manner of selection. The vacuum means also increases the cost of manufacture and operation of the apparatus.

It is therefore an object of my invention to provide apparatus for selecting numbers which practically eliminates any possibility of fraud in its use.

Another object is to provide such apparatus which is simple to operate and requires no power source except manual manipulation.

These and other objects will be more apparent after referring to the following specification and attached drawings in which FIG. 1 is an elevation of one species of my invention;

Figure 1:
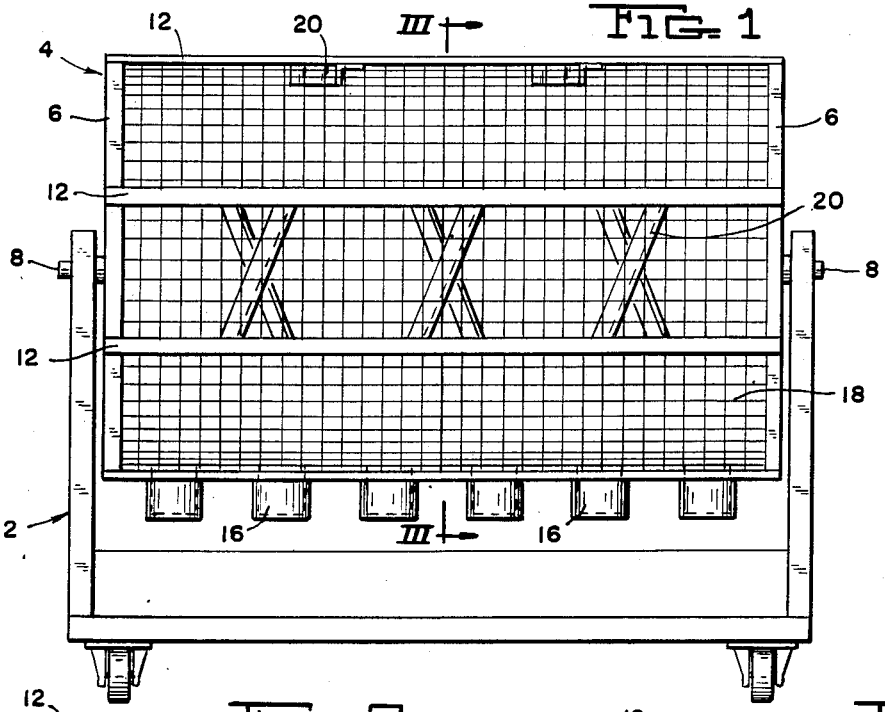
Figure 2:
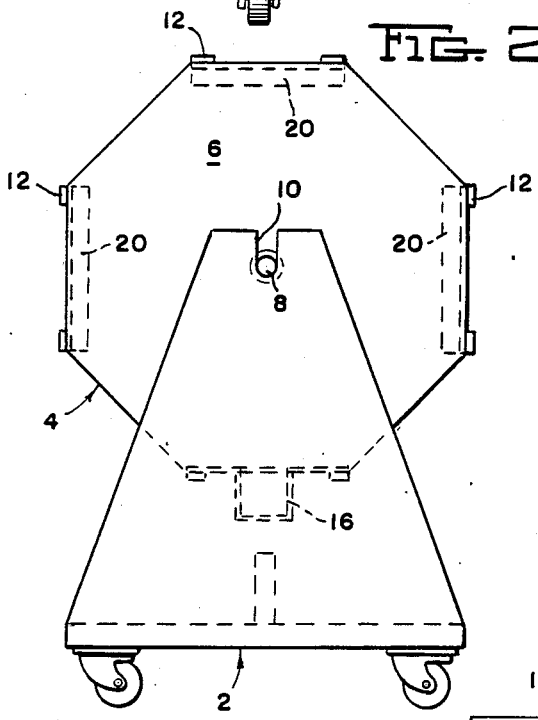
FIG. 2 is an end view of FIG. 1.
Figure 3:
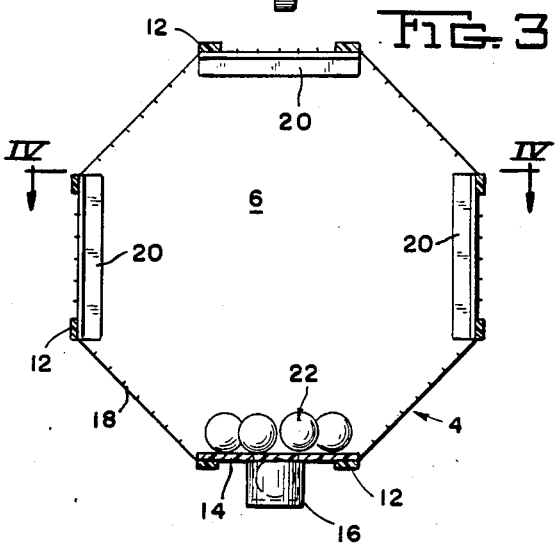
FIG. 3 is a view taken on line III—III of FIG. 1.
Figure 4:
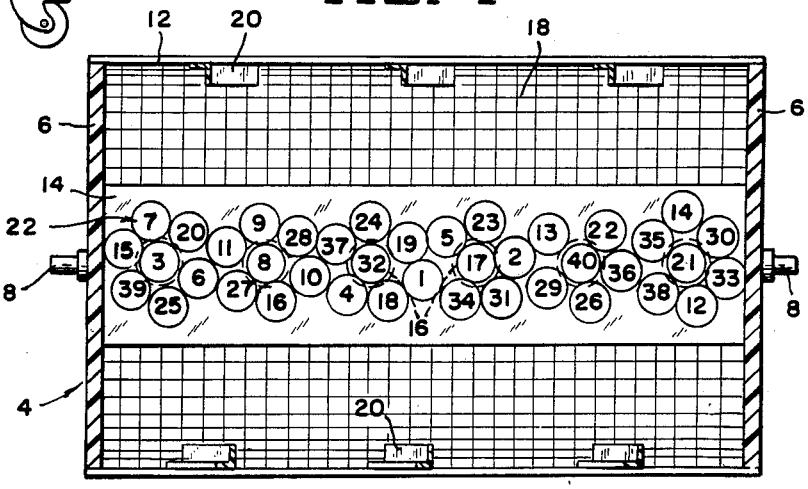
FIG. 4 is a view taken on line IV—IV of FIG. 3.

Referring more particularly to FIGS. 1 to 4 of the drawings reference numeral 2 indicates a stand for rotably supporting a cage 4 about its horizontal longitudinal axis. The cage 4 includes two end pieces 6 with an axle 8 extending therefrom and each supported in a bearing slot 10 on the stand 2. As shown the end pieces 6 are octagonal in shape, but they could be other shapes, such as round. The end pieces 6 are connected by eight spaced apart slats 12. A wide slat 14 is secured to one of the sides of the cage 4, preferably by screws, so that it can be removed for access to the inside of the cage. Attached to the slat 14 are a plurality of outwardly extending pockets 16. The number of pockets may vary, but six are shown. It will be seen that all of the slats are parallel to the axis of the cage and that the pockets 16 are also in a line parallel to the axis. A wire mesh 18 extends around the periphery of the cage, but with a gap where the slot 14 is positioned. The wire mesh is preferably made of a plastic material. A plurality of diverters 20 in the form of angles, preferably made of plastic, are arranged on the inside periphery of the cage 4. While the arrangement of these diverters may vary, a total of ten are shown in two sets of three and two sets of two between the sets of three. Each diverter extends between and is attached to adjacent slats, 12 at an angle to the cage axis and each set of diverters is spaced peripherally from adjacent sets. The slot 14 and pockets 16 are so selected that they provide sufficient weight to insure that they will be at the bottom of the cage when it is at rest. A plurality of numbered balls 22 are placed in the inside of the cage 4. In one particular embodiment forty balls numbered from 1 to 40 are placed in the cage 4. The balls may be pingpong balls and must be of such size that one and only one will go into each pocket 16.

In operation, with the balls inside the cage, the cage is rotated manually for a number of revolutions and eventually comes to rest with a ball in each pocket. The winning number reads from one end to another. The cage is then ready for another operation. It will be seen that the number is decided without any ball being removed or touched by hand. The only possibility of cheating is by reading the numbers erroneously on one or more of the balls in the pockets, but this is prevented by having the correct number and type of reviewers. Numbers with different numbers of digits may be determined by changing the number of pockets or by using only selected pockets to read the numbers.

Figure 5:
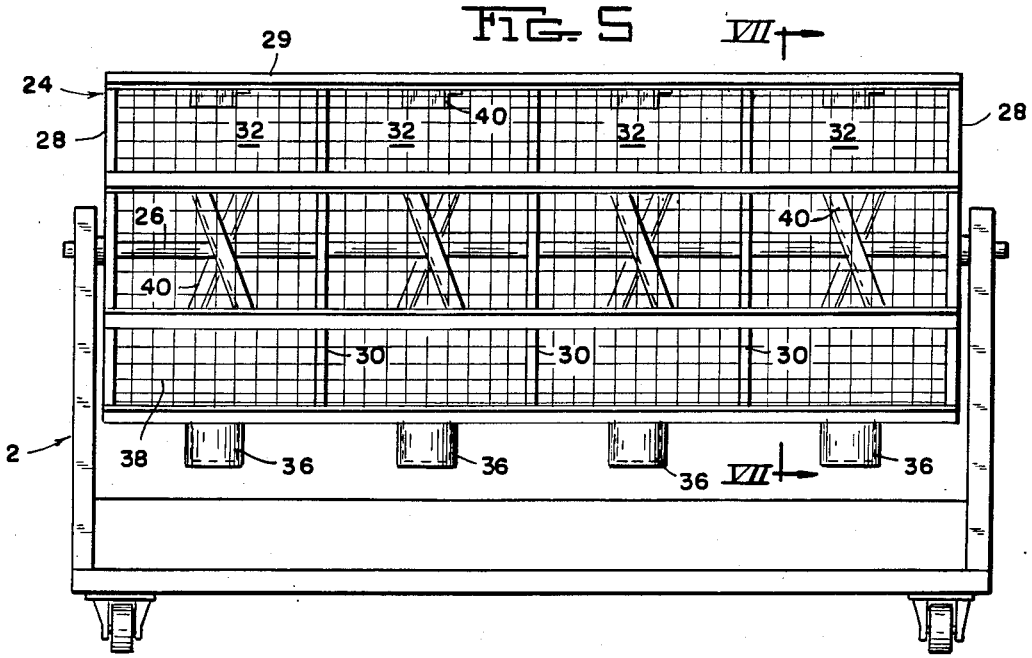
FIG. 5 is an elevation of a second species of my invention.
Figure 6:
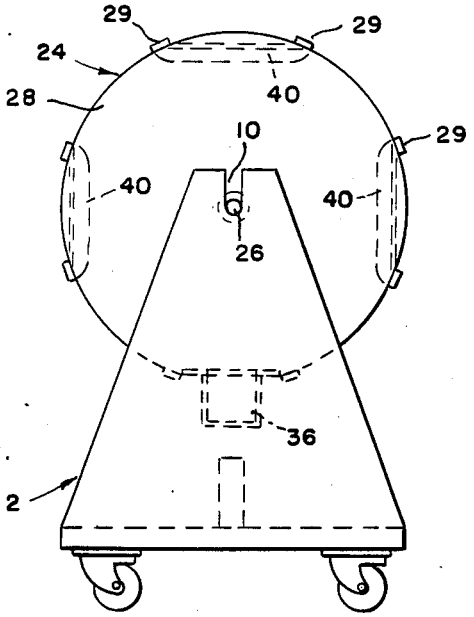
FIG. 6 is an end view of FIG. 5.
Figure 7:
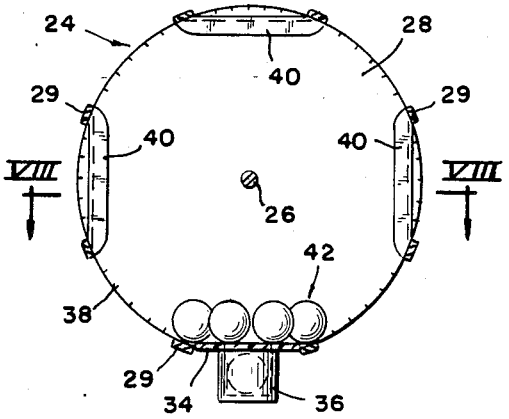
FIG. 7 is a view taken on line VII—VII of FIG. 5.
Figure 8:
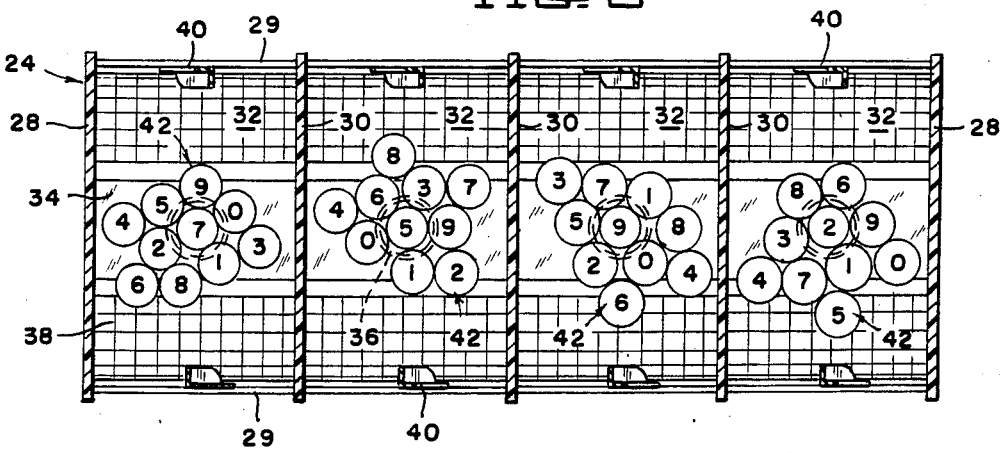
FIG. 8 is a view taken on line VIII—VIII of FIG. 7.

FIGS. 5 to 8 show a second embodiment of my invention which includes a stand 2 which may be identical to that of the first embodiment, but may have a different length between bearings 10. Cage 24 includes an axial rod 26 extending through each circular end piece 28 into bearings 10. The rod 26 also extends through three circular vertical dividers 30 which divides the cage 24 into four compartments 32. The end pieces 28 and dividers 30 are rigidly secured to slats 29. A removable wide slat 34 supports four aligned pockets 36, one in each compartment 32. Wire mesh 38, similar to mesh 18, attached to the end pieces 28, slats 29, and dividers 30 completes the enclosure. Three spaced apart diverters 40, similar to diverters 20, are arranged in each compartment 32. Ten balls 42, numbered 0 to 9, are placed in each compartment 32. The number and numbering of the balls may vary as desired.

The operation of this embodiment is similar to that of the first embodiment. Upon rotation and stopping of rotation one ball will be received in each pocket. The winning number reads from one end to the other. The number of compartments, the number of balls, and numbering of the balls may be changed as desired to obtain numbers of various types, While two embodiments have been shown and described it will be apparent that other modifications and adaptions may be made within the scope of the following claims.

I claim:

1. Apparatus for selecting numbers comprising a rotatable cage, a supporting stand, means on said stand for supporting said cage for rotation about its horizontal longitudinal axis, a plurality of pockets on the periphery of said cage spaced apart in a line parallel to said axis, means providing sufficient weight along said parallel line so that said line is at the bottom of said cage when said cage is at rest, and a plurality of balls in said cage having different numbers thereon and adapted to be received one in each of said pockets, said cage including two end pieces, a plurality of peripherally spaced slats extending between said end pieces and attached thereto, and wire mesh extending around and attached to the periphery of said cage.

2. Apparatus for selecting numbers according to claim 1 in which said weight producing means includes a wide slat extending between said end pieces and supporting the inner ends of said pockets.

3. Apparatus for selecting numbers according to claim 1 including a plurality of ball diverters on the inside of the periphery of said cage and spaced apart longitudinally and peripherally of said cage.

4. Apparatus for selecting numbers according to claim 3 in which said weight producing means includes a wide slat extending between said end pieces and supporting the inner ends of said pockets.

5. Apparatus for selecting numbers according to claim 1 including an axial rod extending through both ends of said cage and its ends forming the means for supporting said cage for rotation, at least one vertical divider in said cage to provide separate compartments in said cage, at least one pocket in each compartment, and a plurality of ball diverters on the inside of the periphery of said cage and spaced apart longitudinally and peripherally of said cage.

6. Apparatus for selecting numbers according to claim 5 in which said weight producing means includes a wide slat extending between said end pieces and supporting the inner ends of said pockets.

* * * * *